US010724322B2

(12) United States Patent
Taylor, Jr. et al.

(10) Patent No.: US 10,724,322 B2
(45) Date of Patent: Jul. 28, 2020

(54) APPARATUS AND METHOD FOR FORMING A LATERAL WELLBORE

(71) Applicant: Weatherford Technology Holdings, LLC, Houston, TX (US)

(72) Inventors: James H. Taylor, Jr., Houston, TX (US); Gary D. Dellinger, Garden Ridge, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 16/052,377

(22) Filed: Aug. 1, 2018

(65) Prior Publication Data

US 2020/0040683 A1 Feb. 6, 2020

(51) Int. Cl.

| | |
|---|---|
| ***E21B 29/06*** | (2006.01) |
| ***E21B 7/06*** | (2006.01) |
| ***E21B 33/13*** | (2006.01) |
| ***E21B 23/01*** | (2006.01) |
| ***E21B 33/12*** | (2006.01) |

(52) U.S. Cl.
CPC ..... *E21B 29/06* (2013.01); *E21B 7/061* (2013.01); *E21B 33/13* (2013.01); *E21B 23/01* (2013.01); *E21B 33/12* (2013.01)

(58) Field of Classification Search
CPC ..... E21B 29/06; E21B 7/061
See application file for complete search history.

(56) References Cited

U.S. PATENT DOCUMENTS 2,770,444 A * 11/1956 Neal ..... E21B 7/061 166/117.5
5,035,292 A * 7/1991 Bailey ..... E21B 7/061 175/45
5,462,120 A * 10/1995 Gondouin ..... E21B 7/061 166/117.6
5,806,596 A * 9/1998 Hardy ..... E21B 7/061 166/117.6
5,957,225 A * 9/1999 Sinor ..... E21B 7/061 175/171
6,460,002 B1 10/2002 Bone et al.
6,464,002 B1 * 10/2002 Hart ..... E21B 7/061 166/117.6
6,695,056 B2 * 2/2004 Haugen ..... E21B 7/061 166/117.6
7,878,253 B2 * 2/2011 Stowe ..... E21B 23/04 166/376
8,833,442 B2 * 9/2014 Ibragimov ..... E21B 7/061 166/117.6
9,506,308 B2 * 11/2016 Vemuri ..... E21B 29/06
9,695,639 B2 7/2017 Vincent et al.
(Continued)

FOREIGN PATENT DOCUMENTS

WO WO-2016209686 A1 * 12/2016 ..... E21B 7/061

OTHER PUBLICATIONS

International Search Report and Written Opinion dated Dec. 20, 2019, for International Application No. PCT/US2019/044127.

*Primary Examiner* — Jennifer H Gay

(74) *Attorney, Agent, or Firm* — Patterson + Sheridan, LLP

(57) ABSTRACT

An assembly for forming a lateral wellbore includes a mill having a bore and a plurality of blades; a whipstock having an inclined surface for guiding movement of the mill, the mill releasably connected to the whipstock; and a tubing disposed in the bore of the mill and the whipstock. In one example, at least one of the plurality of blades is disposed in a slot formed in the whipstock.

21 Claims, 7 Drawing Sheets

(56) References Cited

U.S. PATENT DOCUMENTS

| | | | | |
|---|---|---|---|---|
| 9,932,793 | B2 * | 4/2018 | Lang | E21B 29/06 |
| 9,995,106 | B2 | 6/2018 | Razvi et al. | |
| 10,214,998 | B2 * | 2/2019 | Hussey | E21B 23/01 |
| 2002/0170713 | A1 * | 11/2002 | Haugen | E21B 7/061 166/298 |
| 2007/0289749 | A1 * | 12/2007 | Wood | E21B 23/01 166/387 |
| 2010/0224372 | A1 * | 9/2010 | Stowe | E21B 23/04 166/377 |
| 2012/0255785 | A1 | 10/2012 | Gregurek et al. | |
| 2013/0213654 | A1 | 8/2013 | Dewey et al. | |
| 2013/0319653 | A1 * | 12/2013 | Ibragimov | E21B 7/061 166/117.6 |
| 2014/0338908 | A1 * | 11/2014 | Ervin | E21B 33/13 166/285 |
| 2015/0122495 | A1 | 5/2015 | Vincent et al. | |
| 2016/0258236 | A1 * | 9/2016 | Vemuri | E21B 29/06 |
| 2016/0258237 | A1 * | 9/2016 | Lang | E21B 29/06 |
| 2017/0101838 | A1 | 4/2017 | Razvi et al. | |
| 2019/0003264 | A1 * | 1/2019 | Swadi | E21B 7/061 |
| 2019/0106940 | A1 * | 4/2019 | Korf | E21B 7/061 |

* cited by examiner

APPARATUS AND METHOD FOR FORMING A LATERAL WELLBORE

BACKGROUND

Field

Embodiments of the present disclosure relate to sidetrack drilling for hydrocarbons. In particular, this disclosure relates to a sidetrack assembly for creating a lateral wellbore from a parent wellbore. More particularly still, this disclosure relates to a sidetrack assembly for supplying cement and forming a lateral wellbore.

Description of the Related Art

In recent years, technology has been developed which allows an operator to drill a primary vertical well, and then continue drilling an angled lateral borehole off of that vertical well at a chosen depth. Generally, the vertical, or "parent" wellbore is first drilled and then supported with strings of casing. The strings of casing are cemented into the formation by the extrusion of cement into the annular regions between the strings of casing and the surrounding formation. The combination of cement and casing strengthens the wellbore and facilitates the isolation of certain areas of the formation behind the casing for the production of hydrocarbons.

A lateral wellbore can also be formed off of an open hole parent wellbore. Forming lateral or "sidetrack" wellbore, a tool known as a whipstock is positioned in the parent wellbore at the depth where deflection is desired, typically at or above one or more producing zones. The whipstock is used to divert milling bits into a side of the parent wellbore to create a pilot borehole in the parent wellbore. Thereafter, a drill bit is run into the parent wellbore. The drill bit is deflected against the whipstock, and urged through the pilot borehole. From there, the drill bit contacts the rock formation in order to form the new lateral hole in a desired direction. This process is sometimes referred to as sidetrack drilling.

When forming the lateral wellbore through the parent wellbore, an anchor is first set in the parent wellbore at a desired depth. The anchor is typically a packer having slips and seals. The anchor tool acts as a fixed body against which tools above, it may be urged to activate different tool functions. The anchor tool typically has a key or other orientation-indicating member.

A whipstock is next run into the wellbore. The whipstock has a body that lands into or onto the anchor. A stinger is located at the bottom of the whipstock which engages the anchor device. At a top end of the body, the whipstock includes a deflection portion having a concave face. The stinger at the bottom of the whipstock body allows the concave face of the whipstock to be properly oriented so as to direct the milling operation. The deflection portion receives the milling bits as they are urged downhole. In this way, the respective milling bits are directed against the surrounding wellbore for forming the pilot borehole.

In order to form the pilot borehole, a milling bit, or "mill," is placed at the end of a string of drill pipe or other working string. In some milling operations, a series of mills is run into the hole. First, a starting mill is run into the hole. Rotation of the string with the starting mill rotates the mill, causing a portion of the wellbore to be removed. This mill is followed by other mills, which complete the pilot borehole or extend the lateral wellbore.

In some instances, prior to drilling the sidetrack, it may be desirable to isolate the formation below the whipstock. The formation may be isolated by supplying cement below the whipstock. This is generally at least a two trip process. A first trip to supply the cement, and a second trip to mill the sidetrack wellbore.

There is, therefore, a need for a sidetrack assembly that can perform a cementing operation and form at least a portion of a lateral wellbore in a single trip downhole.

SUMMARY

An assembly for forming a lateral wellbore includes a mill having a bore and a plurality of blades; a whipstock having an inclined surface for guiding movement of the mill, the mill releasably connected to the whipstock; and a tubing disposed in the bore of the mill and the whipstock. In one example, at least one of the plurality of blades is disposed in a slot formed in the whipstock.

In another embodiment, a method for forming a lateral wellbore in a wellbore includes lowering a work string having a drilling member releasably attached to a whipstock, and a tubing connected between the mill and the whipstock. The drilling member includes a blade disposed in slot of the whipstock. The method also includes supplying cement through the drilling member and the tubing to a location below the whipstock; releasing the drilling member from the whipstock; and moving the drilling member along an inclined surface of the whipstock to form at least a portion of the lateral wellbore.

In another embodiment, an assembly for forming a lateral wellbore includes a mill having a bore and a plurality of blades and a lug; a whipstock having an inclined surface for guiding movement of the mill and a lug, the mill releasably connected to the whipstock; and a tubing disposed in the bore of the mill and the whipstock, wherein the lug of the mill is engageable with the lug of the whipstock and configured to apply a downward force to lug of the whipstock.

BRIEF DESCRIPTION OF THE DRAWINGS

So that the manner in which the above recited features of the present disclosure are attained and can be understood in detail, a more particular description of the disclosure, briefly summarized above, may be had by reference to the drawings that follow. The drawings illustrate only selected embodiments of this disclosure, and are not to be considered limiting of its scope.

DETAILED DESCRIPTION OF THE PREFERRED EMBODIMENT

Figure 1:
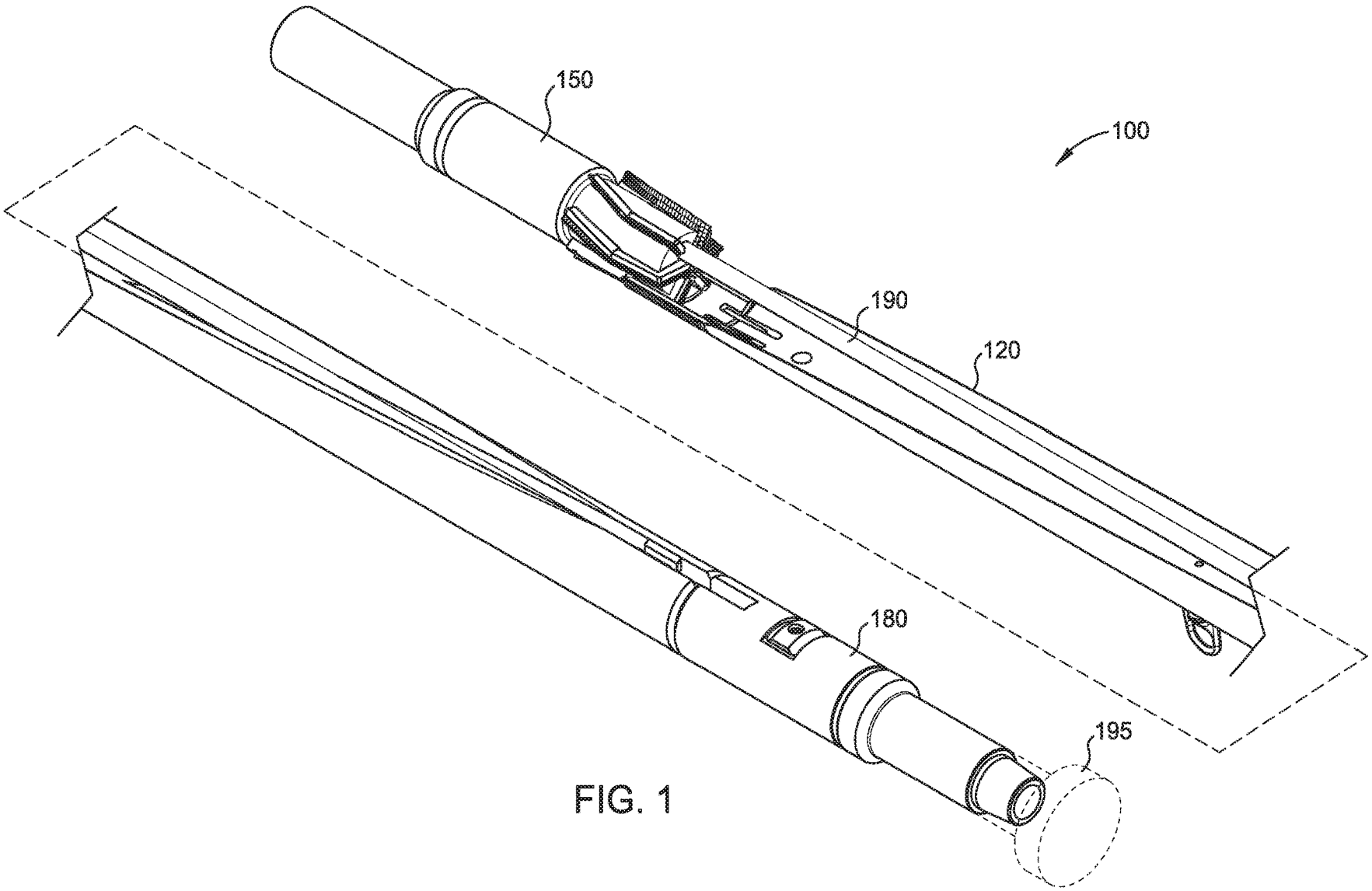
FIG. 1 is a perspective view of one embodiment of a sidetrack assembly for supplying cement and milling at least portion of a lateral wellbore in a wellbore.
Figure 2:
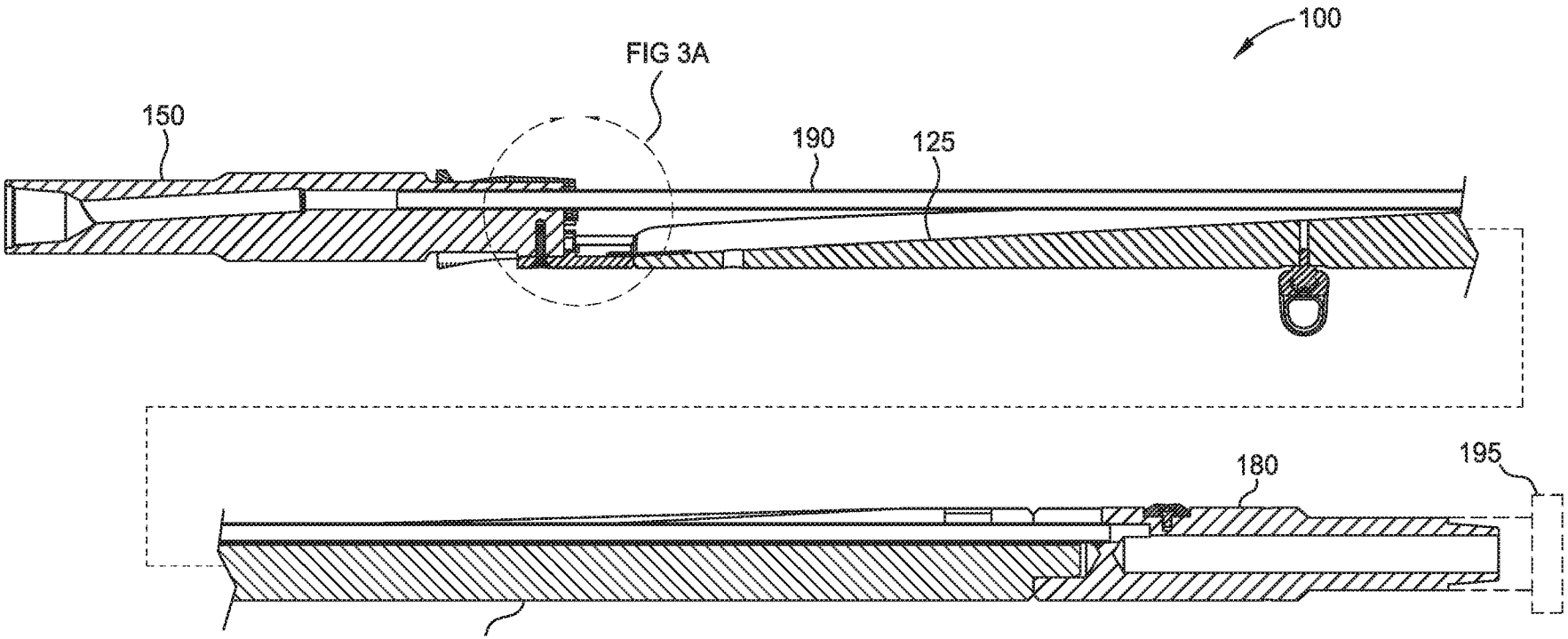
FIG. 2 is a cross-sectional view of the sidetrack assembly of FIG. 1.
Figure 3B:
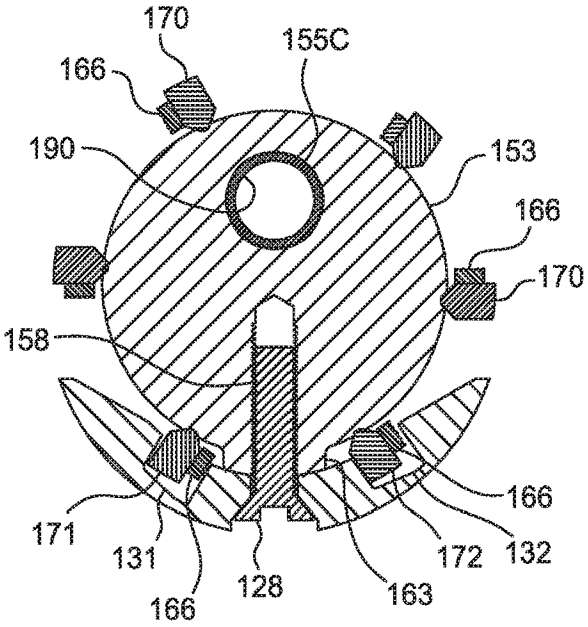
FIGS. 3A and 3B are enlarged partial cross-sectional views of the sidetrack assembly of FIG. 2.
Figure 3A:
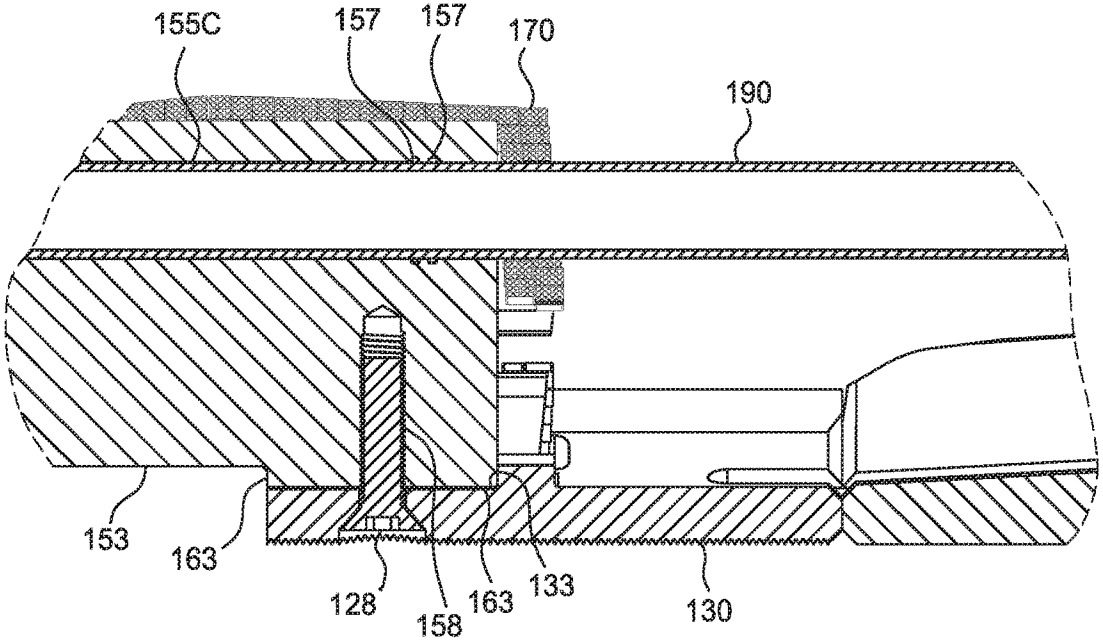

FIG. 1 is a perspective view of one embodiment of a sidetrack assembly 100 for supplying cement and forming at least a portion of a lateral wellbore in a parent wellbore. FIG. 2 is a cross-sectional view of the sidetrack assembly 100 of FIG. 1. FIGS. 3A and 3B are enlarged partial views of the sidetrack assembly 100 of FIG. 2.

In this embodiment, the sidetrack assembly 100 includes a drilling assembly releasably attached to a whipstock 120. The drilling assembly may be a mill 150 or a drill bit. The mill 150 is attached to the upper end of the whipstock 120. The lower end of the whipstock 120 is attached to an adapter 180 for connection to a downhole tool, such as a packer, a fishing tool, and a cement basket. In another embodiment, the adapter 180 is integrated with the whipstock 120. In another embodiment, the adapter 180 is integrated with the downhole tool 195.

The whipstock 120 includes a concave, inclined surface 125 for guiding the path of the mill 150. In one embodiment, the concave surface 125 at the upper portion of the whipstock 120 is an inclined cut out, as shown in FIGS. 1 and 2. The inclined cut out may be achieved using a concave cut on a wall of the whipstock 120. The inclined cut out may begin at the upper end of the whipstock 120 and may extend toward the lower end. In one embodiment, the inclined cut out formed on the upper portion of the whipstock 120 is used as a concave ramp to guide the movement of the mill 150 and set the mill's angle of attack to form a portion of the lateral wellbore, e.g., to form the pilot borehole. In one embodiment, the inclined cut out is between about 2 degrees and 15 degrees; preferably between 2 degrees and 8 degrees; and more preferably between about 2 degrees and 5 degrees.

Figure 3C:
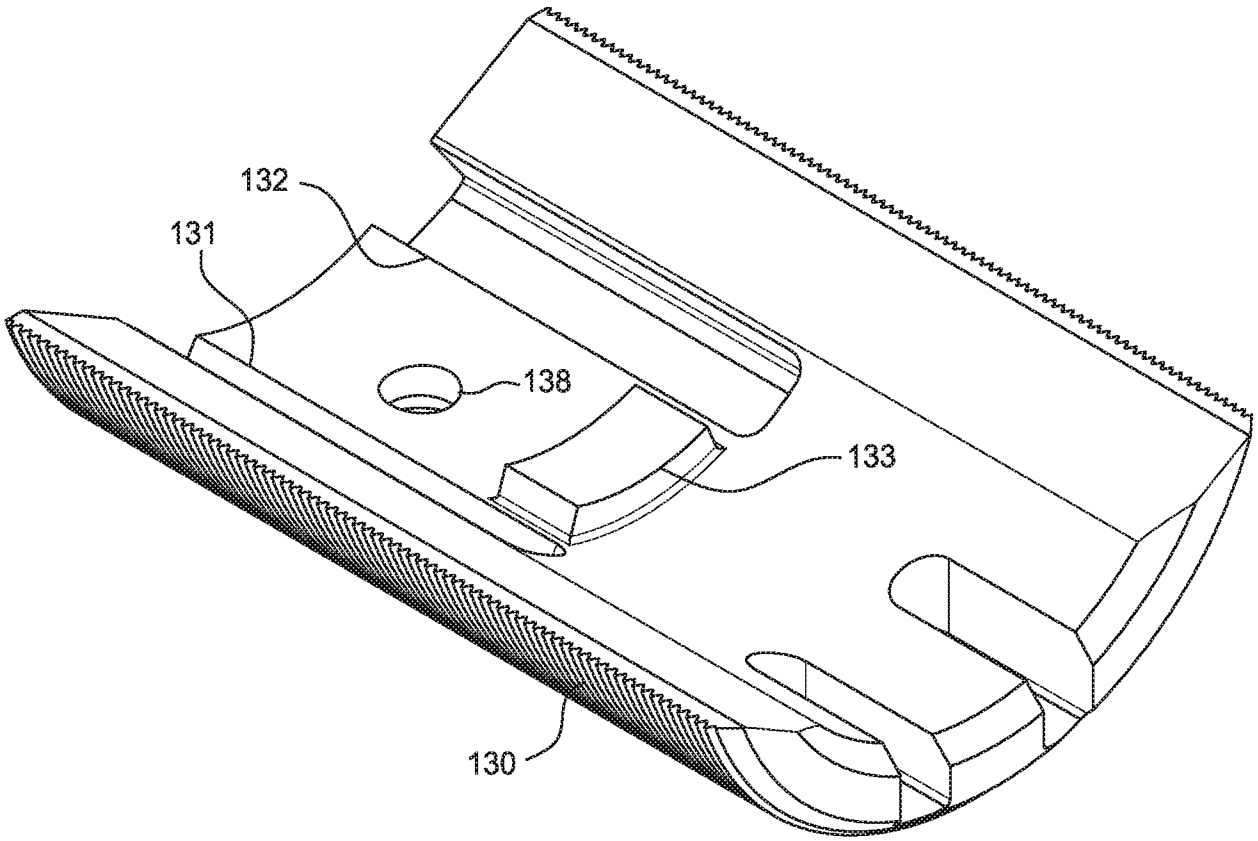
FIG. 3C is a perspective view of an embodiment of an attachment section of a whipstock in accordance with the present disclosure.

During run-in, the mill 150 is attached to the upper end of the whipstock 120 using a shearable member 128 such as a shear screw, as shown in FIG. 3A. The upper end of the whipstock 120 includes an attachment section 130 having flat or substantially flat upper surface. In one example, the upper surface of the attachment section 130 has an incline that is less than 1.5 degrees, less than 1 degree, or less than 0.5 degrees. In one embodiment, the attachment section 130 is attached to the whipstock 120, as shown in FIGS. 3A and 3C. In another embodiment, the attachment section 130 is integrated with the whipstock 120. For example, the attachment section 130 and the whipstock 120 is formed as a single unit. In some embodiments, the concave, inclined surface 125 of the whipstock 120 begins on at least a portion of the attachment section 130.

As shown in the perspective view of FIG. 3C, a lug 133 extends above a top surface of the attachment section 130. In another embodiment, a plurality of lugs are formed above the top surface of the attachment section 130. Two blade slots 131, 132 are formed in the attachment section 130 for receiving two blades of the mill 150. In another embodiment, the blade slots extend to a portion of the concave, inclined surface 125. In another embodiment, a single blade slot is used to receive a blade of the mill 150. A hole 138 is formed through the attachment section 130 to receive the shearable member 128. In this example, the hole 138 is located between the two blade slots 131, 132.

Figure 4A:
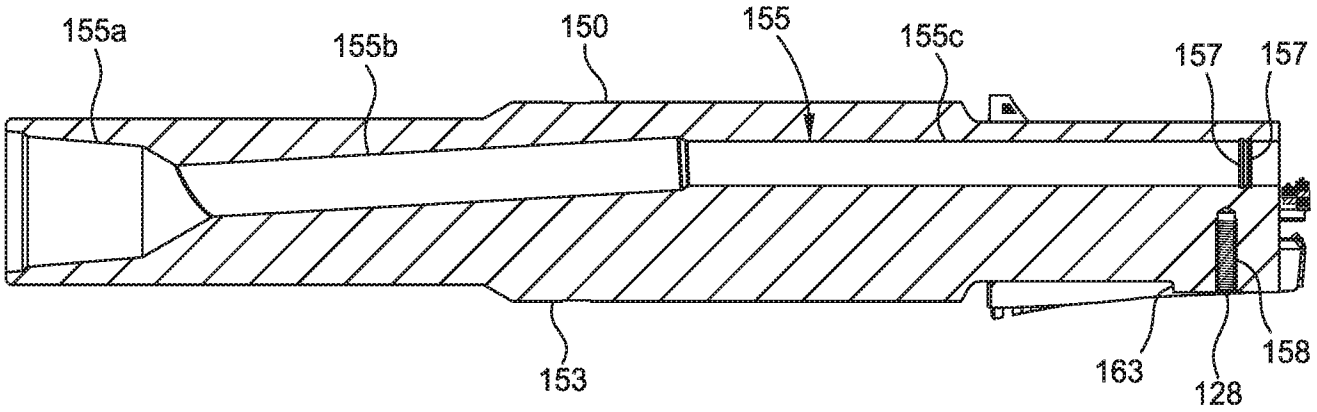
FIG. 4A is a front view of an exemplary mill of the sidetrack assembly in accordance with one embodiment.
Figure 4B:
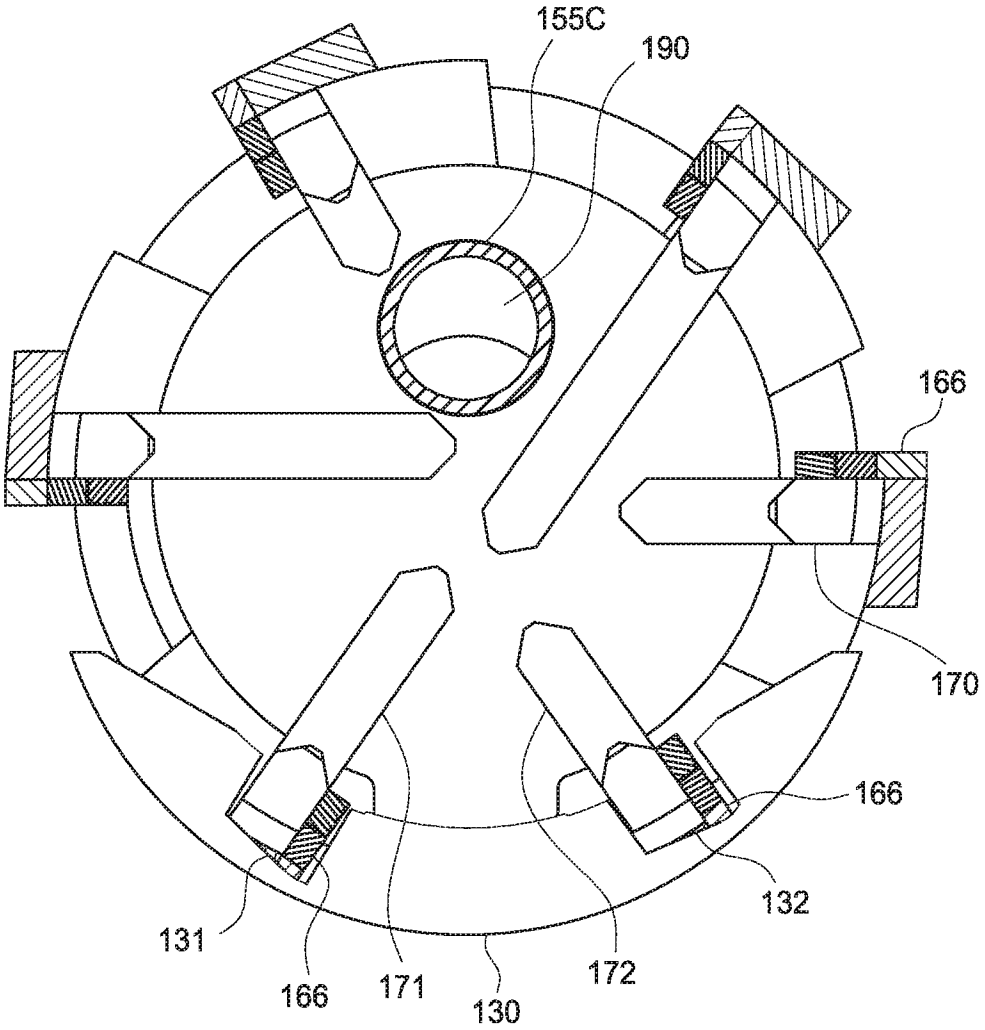
FIG. 4B is a cross-sectional view of the mill of FIG. 4A.

FIG. 4A is a cross-sectional view of the mill 150 of FIG. 2. FIG. 4B is a front view of the mill 150 of FIG. 2. The mill 150 includes a body 153 having a bore 155 extending therethrough. The bore 155 includes an inlet 155A, an angled passage 155B, and an offset passage 155C. The angled portion 155B fluidly connects the inlet 155A to the offset passage 155C. The central axis of the offset passage 155C is located above the central axis of the inlet 155A when the mill 150 is attached to the attachment section 130. The angled portion 155B may be angled between 1 degree and 8 degrees. In one example, the angled portion 155B has an inner diameter that is larger than the inner diameter of the offset passage 155C. One or more sealing members 157, such as o-rings, are disposed in the offset passage 155C near the outlet. In this embodiment, two sealing members 157 are provided. A slot 158 is formed on a bottom portion of the body 153 for engaging the shearable member 128. A lug 163 extends out of the bottom of the mill 150, as shown in FIGS. 3A and 3B. The lug 163 of the mill 150 is configured to engage the lug 133 of the attachment section 130. In one embodiment, the axial force can be transferred from one lug 133, 163 to the other lug 133, 163. For example, the mill 150 can apply a downward force on the whipstock 120 via the lugs 133, 163. The lugs 133, 163 allow the downward force applied to be greater than the force required to shear the shearable member 128. In one embodiment, a clearance exists between the shearable member 128 and the hole 138 in the whipstock 120 to reduce the amount of axial force transfer between the mill 150 and the whipstock 120. For example, the hole 138 is sized so that a minimal amount, such as less than 20%, of the downward force is transferred through the shearable member 128, while most of the downward force is transferred through the lugs 133, 163.

Figure 5:
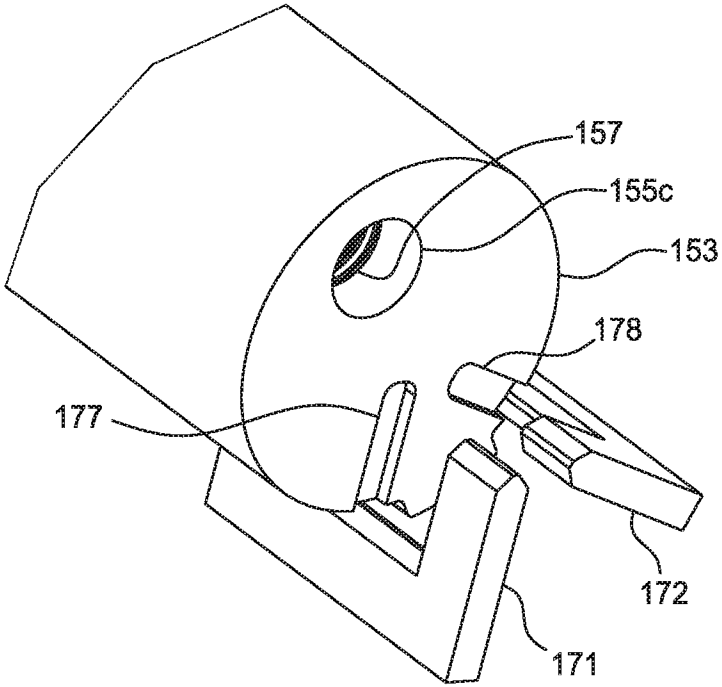
FIG. 5 is a perspective view an exemplary mill of the sidetrack assembly in accordance with the present disclosure.

The mill 150 is equipped with two or more blades 170, such as two, four, five, six, and eight blades. As shown in FIGS. 3B and 4B, the mill 150 includes six blades 170 arranged circumferentially on the mill 150. The blades 170 are disposed at various angles to accommodate position of the offset passage 155C. A plurality of cutting inserts 166 may be attached to a cutting surface of the blades 170. Two of the blades 171, 172 are disposed in the blades slots 131, 132 respectively, of the attachment section 130. While two blades are shown, it is contemplated that one or three blades are disposed in the blade slots of the whipstock 120. The blades 171, 172 in the slots 131, 132 can serve as torque keys to transfer torque from the mill 150 to the whipstock 120. As the mill 150 is rotated, the cutting inserts 166 of the blades 171, 172 will engage the sidewall of the slot 131, 132 to transfer torque to the whipstock 120. In one embodiment, the clearance between the blade 171 and the sidewall of the slot 131 is smaller than the clearance between the blade 172 and the sidewall of the slot 132. In this respect, when rotated, the blade 171 will engage the sidewall of the slot 131 before the blade 172 will engage the sidewall of the slot 132. In one embodiment, a clearance exists between the shearable member 128 and the hole 138 in the attachment section 130 to reduce the amount of torque transfer. For example, the hole 138 is sized such that a minimal amount, such as less than 20%, of the applied torque is transferred through the shearable member 128. In one embodiment, to facilitate the positioning of the blades 171, 172 in the respective slots 131, 132, grooves 177, 178 are formed in the mill body 150 for receiving the blades 171, 172 as shown in FIG. 5. The grooves 177, 178 facilitate proper attachment of the blades 171, 172 to the mill 150, which ensures the blades 171, 172 align with the slots 131, 132 during assembly. In one embodiment, the blades 171, 172 are in direct contact with the slots 131, 132. In another embodiment, an intermediate structure, such as a liner, is disposed in the slots 131, 132 and in contact with the blades 171, 172. The intermediate structure may be used to control the clearance between the blades and the slots.

In one embodiment, the sidetrack assembly 100 includes a flow path for supplying cement from the mill 150 to the wellbore below the whipstock 120. Referring to FIGS. 1 and 2, a tubing 190 is disposed in the whipstock 120. The lower end of the tubing 190 extends out of the whipstock 120 and is connectable with the adapter 180. The tubing 190 fluid communicates with the central passage of the adapter 180. The adapter 180 may be attached to a downhole tool 195, thereby placing the tubing 190 in fluid communication with the downhole tool 195. In one embodiment, the downhole tool is packer, anchor, or a combination of packer and anchor assembly. For example, the anchor may include a plurality of slips disposed on a mandrel having a bore. The packer may include a sealing element disposed on a mandrel having a bore. An exemplary packer is an inflatable packer.

The upper end of the tubing 190 extends out of the whipstock 120 and is connectable with the offset passage 155C of the mill 150. During installation, the upper end of the tubing 190 is inserted into the offset passage 155C. The sealing members 157 engage the tubing 190 to prevent leakage. In one embodiment, the section of the tubing 190 inserted into the offset passage 155C is from 2 in. to 36 in., from about 3 in. to 24 in., or from about 6 in. to 18 in.

During assembly, the mill 150 is releasably attached to the whipstock 120. The tubing 190 is inserted into the offset passage 155C, and the blades 171, 172 are positioned in slots 131, 132, respectively, of the attachment section 130. The shearable screw 128 is inserted through the hole 138 of the attachment section 130 and the slot 158 of the mill 150 to releasably attach the mill 150 to the whipstock 120. In this example, the lug 163 of the mill 150 is engaged with the lug 133 of the attachment section 130. In this respect, axial force may be transmitted from the mill 150 to the whipstock 120.

In operation, a downhole tool 195, such as a packer, is attached to the whipstock 120. The mill 150 and the whipstock 120 are lowered into the wellbore using a workstring. In this example, the wellbore is an open hole wellbore. However, this operation may be performed in a cased wellbore. While being lowered, the mill 150 can apply a downward force on whipstock 120 via the lugs 133, 163. After reaching the location of the pilot borehole to be formed, the packer is set below the pilot borehole. In one embodiment, the inclined surface 125 of whipstock 120 is oriented to the appropriate azimuth in the borehole to guide the path of the mill 150. The wellbore below the packer is isolated from the whipstock 120. Cement is supplied through the workstring, the bore 155 of the mill 150, the tubing 190, and the passage of the adapter 180. The cement exits below the packer and into the wellbore. In another embodiment, cement is supplied below the packer before setting the packer. In yet another embodiment, the cement is located above and below the packer. In one embodiment, the cement is used to inflate the packer. For example, an actuating device, such as a ball or a dart, is dropped into the workstring. The actuating device travels through the bore 155 of the mill 150, the tubing 190, and lands in a downhole tool, such as a packer or an anchor, attached to the whipstock 120. Pressure is increased to cause the ball to shift a sleeve in the downhole tool, thereby opening a port in the downhole tool. Fluid can be supplied through the port to actuate the downhole tool. Exemplary fluids include cement, drilling fluid such as a drilling mud, and completion fluid such as brine. In some embodiments, the downhole tool includes a one way valve such as a check valve that prevents the fluid from flowing out of the downhole tool. If the downhole tool is a packer, the fluid can be used to inflate the packer. In some embodiments, fluid flow through the downhole tool is re-established by increasing pressure to release the ball from the sleeve.

To release the mill 150, a tension force is applied to the mill 150 by pulling up on the mill 150. A sufficient force is applied to break the shear screw 128. After release, the mill 150 is pulled away from the whipstock 120 to separate the tubing 190 from the mill 150. The mill 150 is then urged along the whipstock 120, which deflects the mill 150 outward into engagement with the wellbore. The tubing 190 will be milled as the mill 150 travels along the whipstock 120. The mill 150 is operated to form at least a portion of the lateral wellbore. Thereafter, the mill 150 is retrieved. In this manner, a supplying cement through the whipstock and forming at least a portion of the lateral wellbore can be achieved in a single trip. In some instances, a drill bit is lowered into the wellbore in a second trip and operated to extend the lateral wellbore.

In one embodiment, an assembly for forming a lateral wellbore includes a mill having a bore and a plurality of blades; a whipstock having an inclined surface for guiding movement of the mill, the mill releasably connected to the whipstock; and a tubing disposed in the bore of the mill and the whipstock. In one example, at least one of the plurality of blades is disposed in a slot formed in the whipstock.

In another embodiment, an assembly for forming a lateral wellbore includes a mill having a bore and a plurality of blades and a lug; a whipstock having an inclined surface for guiding movement of the mill and a lug, the mill releasably connected to the whipstock; and a tubing disposed in the bore of the mill and the whipstock, wherein the lug of the mill is engageable with the lug of the whipstock and configured to apply a downward force to lug of the whipstock.

In one or more of the embodiments described herein, the at least one blade is configured to transfer torque to the whipstock when the at least one blade is disposed in the slot.

In one or more of the embodiments described herein, two blades are in disposed in a respective slot formed in the whipstock for each blade.

In one or more of the embodiments described herein, a clearance between a first blade in a first slot is smaller than a clearance between a second blade and a second slot.

In one or more of the embodiments described herein, the mill includes a lug engaged with a lug of the whipstock for transfer of an axial force.

In one or more of the embodiments described herein, a sealing member disposed between the tubing and the bore of the mill.

In one or more of the embodiments described herein, the slot is formed in an attachment section having a flat upper surface.

In one or more of the embodiments described herein, the bore includes an inlet, an angled passage and an offset passage.

In one or more of the embodiments described herein, the tubing is disposed in the offset passage.

In one or more of the embodiments described herein, a central axis of the offset passage is located above a central axis of the inlet when the mill 150 is attached to the whipstock.

In one or more of the embodiments described herein, the tubing is configured to supply fluid to a location below the whipstock.

In one or more of the embodiments described herein, a shearable member releasably connecting the mill and the whipstock.

In one or more of the embodiments described herein, the whipstock includes an opening for receiving the shearable member, and a clearance exists between the shearable member and a wall of the opening.

In one or more of the embodiments described herein, the mill is movable relative to the tubing upon release of the mill from the whipstock.

In another embodiment, a method for forming a lateral wellbore in a wellbore includes lowering a work string having a drilling member releasably attached to a whipstock, and a tubing connected between the mill and the whipstock. The drilling member includes a blade disposed in slot of the whipstock. The method also includes supplying a fluid through the drilling member and the tubing to a location below the whipstock; releasing the drilling member from the whipstock; and moving the drilling member along an inclined surface of the whipstock to form at least a portion of the lateral wellbore.

In one or more of the embodiments described herein, the method includes rotating the mill and transferring torque from the mill to the whipstock via the blade and the slot.

In one or more of the embodiments described herein, the mill includes a first lug and the whipstock includes a second lug, and the method further comprises transferring axial force from the first lug of the mill to the second lug of the whipstock.

In one or more of the embodiments described herein, releasing the drilling member comprises applying a tension force on the drilling member to break a shearable member.

In one or more of the embodiments described herein, supplying cement comprises supplying cement through an angled bore of the mill.

In one or more of the embodiments described herein, moving the drilling member along an inclined surface comprises milling the tubing.

In one or more of the embodiments described herein, the method includes lowering a second drilling member to extend the lateral wellbore.

In one or more of the embodiments described herein, the method includes supplying cement to inflate a packer attached to the whipstock In one or more of the embodiments described herein, the assembly includes a sealing member disposed between the tubing and the bore of the mill.

In one or more of the embodiments described herein, at least two blades are disposed in a respective slot formed in the whipstock for each blade.

In one or more of the embodiments described herein, the at least two blades are configured to transfer torque to the whipstock when the at least two blades are disposed in the slots.

In one or more of the embodiments described herein, a clearance between a first blade in a first slot is smaller than a clearance between a second blade and a second slot.

In one or more of the embodiments described herein, wherein the location is in a downhole tool.

In one or more of the embodiments described herein, the method includes moving an actuating device through the mill and the tubing.

In one or more of the embodiments described herein, the method includes shifting a sleeve to open a port in the downhole tool.

In one or more of the embodiments described herein, wherein the fluid is selected from the group consisting of cement, drilling fluid, and completion fluid.

In one or more of the embodiments described herein, wherein the downhole tool comprises a packer, and the method includes inflating the packer.

While the foregoing is directed to embodiments of the present disclosure, other and further embodiments of the disclosure may be devised without departing from the basic scope thereof, and the scope thereof is determined by the claims that follow.

The invention claimed is:

1. An assembly for forming a lateral wellbore, comprising:

a mill having a bore and a plurality of blades;

a whipstock having an inclined surface for guiding movement of the mill, the mill releasably connected to the whipstock; and a tubing disposed in the bore of the mill and in the whipstock, wherein two blades are disposed in a respective slot formed in the whipstock for each blade.

2. The assembly of claim 1, wherein the at least one blade is configured to transfer torque to the whipstock when the at least one blade is disposed in the slot.

3. The assembly of claim 1, wherein a clearance between a first blade in a first slot is smaller than a clearance between a second blade and a second slot.

4. The assembly of claim 1, wherein the mill includes a lug engaged with a lug of the whipstock for transfer of an axial force.

5. The assembly of claim 1, wherein the slot is formed in an attachment section having a flat upper surface.

6. The assembly of claim 1, wherein the bore of the mill includes an inlet, an offset passage, an angled passage connecting the inlet to the offset passage.

7. The assembly of claim 6, wherein the tubing is disposed in the offset passage.

8. The assembly of claim 7, wherein a central axis of the offset passage is spaced from a central axis of the inlet when the mill is attached to the whipstock.

9. The assembly of claim 1, wherein the tubing is configured to supply fluid to a location below the whipstock.

10. The assembly of claim 1, further comprising a shearable member configured to releasably connect the mill and the whipstock.

11. The assembly of claim 10, wherein mill is movable relative to the tubing upon release of the mill from the whipstock.

12. A method for forming a lateral wellbore in a wellbore, comprising:

lowering a work string having a drilling member releasably attached to a whipstock, and a tubing connected between the drilling member and the whipstock, the drilling member having two blades disposed in a respective slot of the whipstock;

supplying a fluid through the drilling member and the tubing to a location below the whipstock;

releasing the drilling member from the whipstock; and moving the drilling member along an inclined surface of the whipstock to form the lateral wellbore.

13. The method of claim 12, further comprising supplying cement to inflate a packer attached to the whipstock.

14. The method of claim 12, further comprising rotating the drilling member and transferring torque from the drilling member to the whipstock via the blade and the slot.

15. The method of claim 12, wherein the drilling member includes a first lug and the whipstock includes a second lug, and the method further comprises transferring axial force from the first lug of the drilling member to the second lug of the whipstock.

16. The method of claim 12, wherein supplying cement comprises supplying cement through an angled bore of the drilling member.

17. The method of claim 12, wherein moving the drilling member along an inclined surface comprises milling the tubing.

18. An assembly for forming a lateral wellbore, comprising:

a mill having a bore and a plurality of blades and a lug;

a whipstock having an inclined surface for guiding movement of the mill and a lug, the mill releasably connected to the whipstock using a shearable member; and a tubing disposed in the bore of the mill and in the whipstock, wherein the lug of the mill is engageable with the lug of the whipstock and configured to apply a downward force to lug of the whipstock while the mill is releasably connected to the whipstock using a shearable member.

19. An assembly for forming a lateral wellbore, comprising:

a mill having a bore and a plurality of blades, wherein the bore includes:

an inlet having a central axis;

an offset passage having a central axis that is offset from the central axis of the inlet; and an angled passage connecting the inlet to the offset passage, the angled passage angled relative to the central axis of the inlet;

a whipstock having an inclined surface for guiding movement of the mill, the mill releasably connected to the whipstock; and a tubing disposed in the whipstock and the bore of the mill, wherein at least two of the plurality of blades are disposed in a respective slot formed in the whipstock.

20. The assembly of claim 19, wherein the central axis of the inlet is spaced between the central axis of the offset bore and a connection between the whipstock and the mill.

21. The assembly of claim 19, wherein the central axis of the inlet is spaced between the central axis of the offset bore and the slot.

* * * * *